US006036916A

United States Patent [19]

Gohres et al.

[11] Patent Number: 6,036,916

[45] Date of Patent: Mar. 14, 2000

[54] VESSEL FOR METALLURGICAL PURPOSES

[75] Inventors: Hans Werner Gohres, Duisburg; Klaus Kobusch, Krefed; Franz-Josef Divjak, Rheinberg; Kurt Siewert; Detlef Kirstinat, both of Duisburg, all of Germany

[73] Assignee: Mannesmann AG, Düsseldorf, Germany

[21] Appl. No.: 09/051,186

[22] PCT Filed: Oct. 1, 1996

[86] PCT No.: PCT/DE96/01906

§ 371 Date: Apr. 6, 1998

§ 102(e) Date: Apr. 6, 1998

[87] PCT Pub. No.: WO97/13598

PCT Pub. Date: Apr. 17, 1997

[30] Foreign Application Priority Data

Oct. 6, 1995 [DE] Germany ..... 195 38 530

[51] Int. Cl.[7] ..... B22D 41/04

[52] U.S. Cl. ..... 266/246; 266/275

[58] Field of Search ..... 266/44, 245, 246, 266/247, 275, 276

[56] References Cited

U.S. PATENT DOCUMENTS 909,655 1/1909 Palmer ..... 266/275

2,294,044 8/1942 Nielsen ..... 266/246

4,131,265 12/1978 McCray ..... 266/275

*Primary Examiner*—Scott Kastler

*Attorney, Agent, or Firm*—Cohen, Pontani, Lieberman & Pavane

[57] ABSTRACT

A vessel for metallurgical purposes and in particular a vessel for transporting molten metals, having a metal casing formed of individual tubular shells with a heat-resisting lining affixed thereto. Two stiffening rings extend circumferentially around the casing. Two vessel carrying trunnions are arranged opposite one another at the outer side of the metal casing and are supported by a plate connected to each stiffening ring. The stiffening rings are provided as an integrated component part of the metal casing. The middle area of the plate is positioned a distance from the metal casing. Upper and lower rim-line edge areas of the plate are connected, preferably welded, to the stiffening rings located adjacent thereto. The vessel carrying trunnions extend only outwardly from the plate. Depending upon the axial dimensioning of the vessel, more than two stiffening rings may be provided. The vessel of the present invention is uniformly stressed when subjected to combined load and heat and can withstand a characteristic temperature of up to 400° C.

7 Claims, 2 Drawing Sheets

VESSEL FOR METALLURGICAL PURPOSES

BACKGROUND OF THE INVENTION

1. Field of the Invention

The present invention relates to a vessel for metallurgical purposes and in particular, a vessel for molten metals.

2. Description of the Related Art

Vessels for metallurgical purposes are used to transport molten metals, such as pig iron, from the blast furnace to the pig iron mixer or from the pig iron mixer to the converter. The vessel can also be used as metallurgical treatment vessels. As requirements have increased with respect to the degree of purity and the reduction in dissolved gas content of the molten metal, vacuum treatment has a more important method. In the vacuum treatment method, for reasons relating to the process, operation is conducted with a high overheating temperature. This results in especially high thermal loading of the treatment vessel. In vessels of conventional construction, the increased loading of weight and heat combined can lead to undesirable deformations. This is especially true for vessels having oval cross sections. The distortions can be so great as to cause constrictions in the area of the reinforcing or stiffening rings. Moreover, the carrying trunnions can become skewed so that difficulties occur when fitting the crane hook into the loops.

DE 29 01 011 B1 discloses a carrying trunnion fastening and bearing pin fastening for casting ladles in which the bearing pin projects into a cut-out in the casing of the casting ladle by the ladle foot and is welded to the edge of the cut-out. A rectangular fastening plate is fitted to the side of the bearing pin. The fastening plate is arranged between two stiffening rings which are fastened to the casing of the casting ladle. The plate is welded to the casing and to the stiffening rings. The fastening plate, which is cast integral with the bearing pin in a known manner, is provided at each of its lateral edges with a leg which is cast integral thereto. Each leg extends between the stiffening rings, and is welded to the casing approximately vertical to the fastening plate.

This bearing pin fastening arrangement is simple to construct and economical to manufacture. This arrangement also makes it easier to check for cracks or the like because only four circumferentially extending weld seams are required. The weld seams are easily accessible from the outside and can therefore be easily checked by ultrasound or other similar devices.

SUMMARY OF THE PRESENT INVENTION

The object of the present invention is to provide a vessel for metallurgical purposes which is uniformly stressed when subjected to a combination of load and heat, and in particular a vessel that can withstand a characteristic temperature of up to 400° C. Moreover, the loops for the crane hook remain perpendicular in all operating states.

Pursuant to this object, the inventive vessel for transporting molten metals, includes a metal casing formed of individual tubular shells. Stiffening rings extend circumferentially around the casing. Two vessel carrying trunnions are arranged opposite one another at an outer side of the metal casing, each trunnion being supported by a plate connected to the stiffening rings. In a preferred embodiment of the present invention, in dependence upon the axial dimensioning of the vessel, more than two stiffening rings may be provided as an integrated component part of the metal casing. Furthermore, the middle area of the plate is arranged at a distance from the metal casing. Additionally, upper and lower rim-like edge areas of the plate are connected, for example by a weld, to the stiffening rings located adjacent thereto. The vessel carrying trunnions advantageously extend outward from the plate so as not to contact the partial casing.

The configuration of the stiffening rings, such as the radial dimensioning or the thickness is determined by factors relating to the position of the ring on the casing. The plate is advantageously fastened in such a way that it is welded directly to the lower stiffening ring and to the underside of the upper stiffening ring in such a way that the plate terminates flush with the outer surface of the stiffening ring.

A stiffening ring is also connected to the metal casing at the edge of the vessel, so as to prevent buckling or indentation at the edge.

Depending on use, it may be required to cover the vessel in order to minimize thermal radiation losses, particularly for ladles used for continuous casting, which stand for long periods in the ladle turning tower. Without a cover, the upper melt region would cool sharply, thereby causing impermissible stresses in the ladle casing. Therefore, in an advantageous embodiment of the present invention a roof or cover is provided which is connected, preferably by welding, to the upper stiffening ring.

The features of the present invention advantageously;

do not hinder deformation at any location, do not allow any impermissible material accumulation, shift the stiffness of the vessel into the head region and thus into a cooler area, and stabilize the narrow side when the vessel has an oval shape.

The above features can be advantageously combined so as to provide a vessel having optimum operating strength.

Several advantages of the vessel, according to the present invention, are that no impermissible deformations occur even at high characteristic temperatures and that stresses in the material of the vessel are uniformly distributed. As a result the geometry of the vessel does not change when subjected to a combination of heavy weight and high temperature loading. This is particularly evidenced in that the carrying trunnions remain horizontal.

Other objects and features of the present invention will become apparent from the following detailed description considered in conduction with the accompanying drawings. It is to be understood however that the drawings are designed solely for the purposes of illustration and not as definition of the limits of the invention, for which reference should be made to the appended claims.

DETAILED DESCRIPTION OF THE PREFERRED EMBODIMENTS

Figure 1:
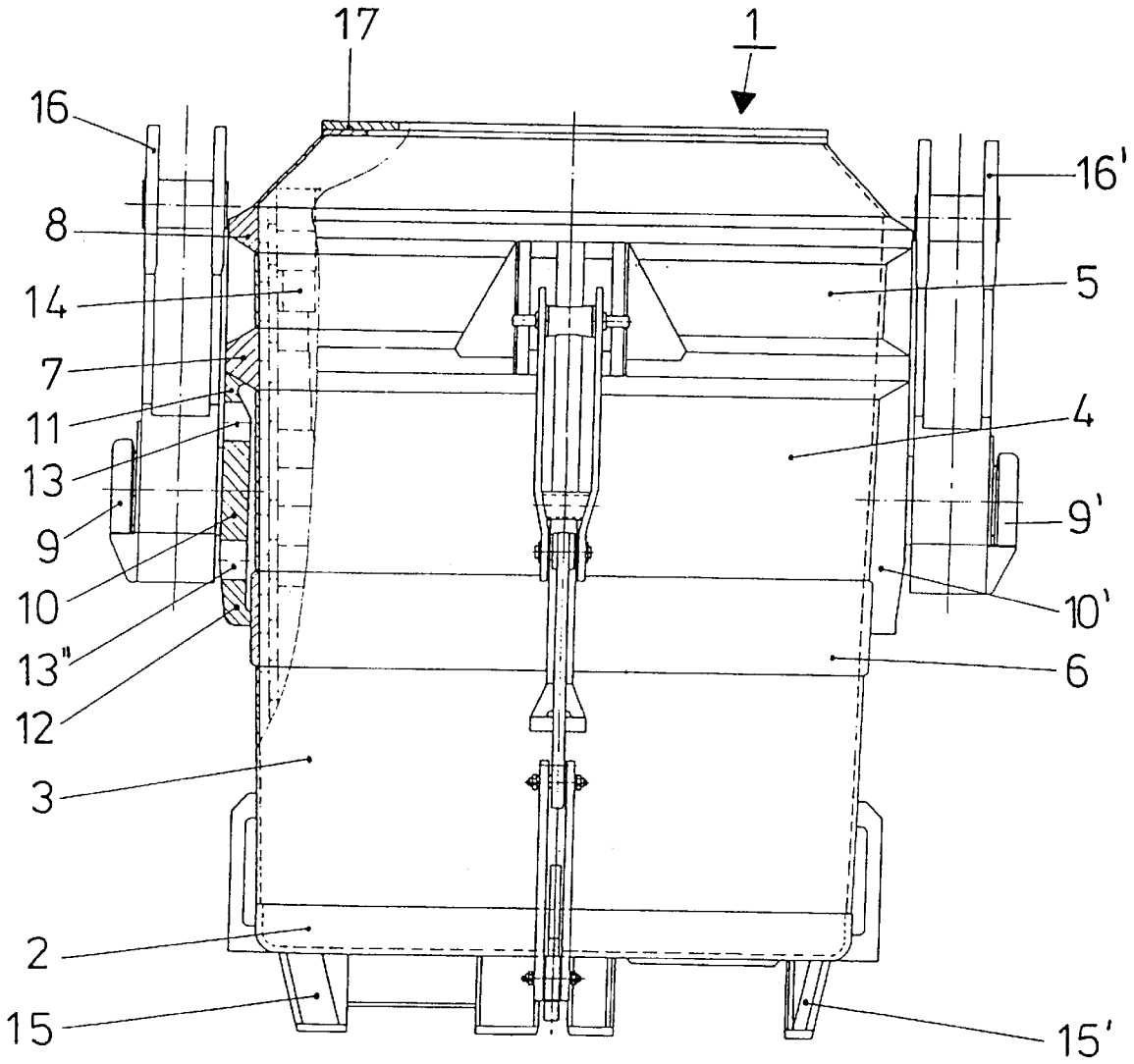
FIG. 1 shows a partially broken out elevational view of an embodiment of a vessel according to the present invention.

FIG. 1 shows a partially broken out view of a vessel according to an embodiment of the present invention, configured as a steel casting ladle 1. The ladle 1 comprises a metal casing and a ladle base 2 attached thereto. In the illustrated embodiment, the metal casing has three shell rings or tubular shells 3 to 5, wherein each ring 3–5 has a different width. Depending on the height and arrangement of the ladle 1 the number of tubular shells may be greater or less than in the illustrated embodiment. Stiffening rings 6, 7 are arranged circumferentially between two tubular shells 3, 4 and 4, 5, respectively, the stiffening rings 6, 7 not being attached to the ladle casing, as is customary. According to the illustrated embodiment, another stiffening ring 8 is arranged circumferentially at an upper end of the casing, so that the stiffening ring 8 forms an edge of the ladle 1. The individual stiffening rings 6 to 8 are axially and radially dimensioned in dependence on parameters relating to load forces and temperatures imposed on the casing. In a feature of the present invention, a plate 10, 10', has a middle area and upper and lower rim-like edge areas 11,12, the rim-like edge areas 11,12 being mounted, such as by welding, to the stiffening ring 6,7 located adjacent thereto. A carrying trunnion 9,9' extends perpendicularly outward from the middle area of the plate 10,10'. Advantageously, the middle area of the plate 10,10' is separated from the casing by a distance, thereby preventing direct heat transfer from the casing to the plate 10,10' and subsequently to the carrying trunnion 9,9'. Relief recesses 13–13''' are arranged symmetrically around the trunnion mounting location in the plate 10, 10'. A refractory lining 14 comprising a plurality of layers is arranged on the inside of the metal casing, shown here in dashed lines. Feet 15, 15' are provided on the underside of the ladle 1 so as to support the ladle 1 when the ladle 1 is set down. Loops 16, 16' are attached to the respective carrying trunnions 9, 9', the loops 16, 16' being engageable by a standard crane hook (not shown) for lifting the ladle 1. A cover 17 is fastened to the upper stiffening ring 8. In an advantageous embodiment of the present invention, the cover 17 is an annular cover having a truncated cone-shaped cross-section.

Figure 2:
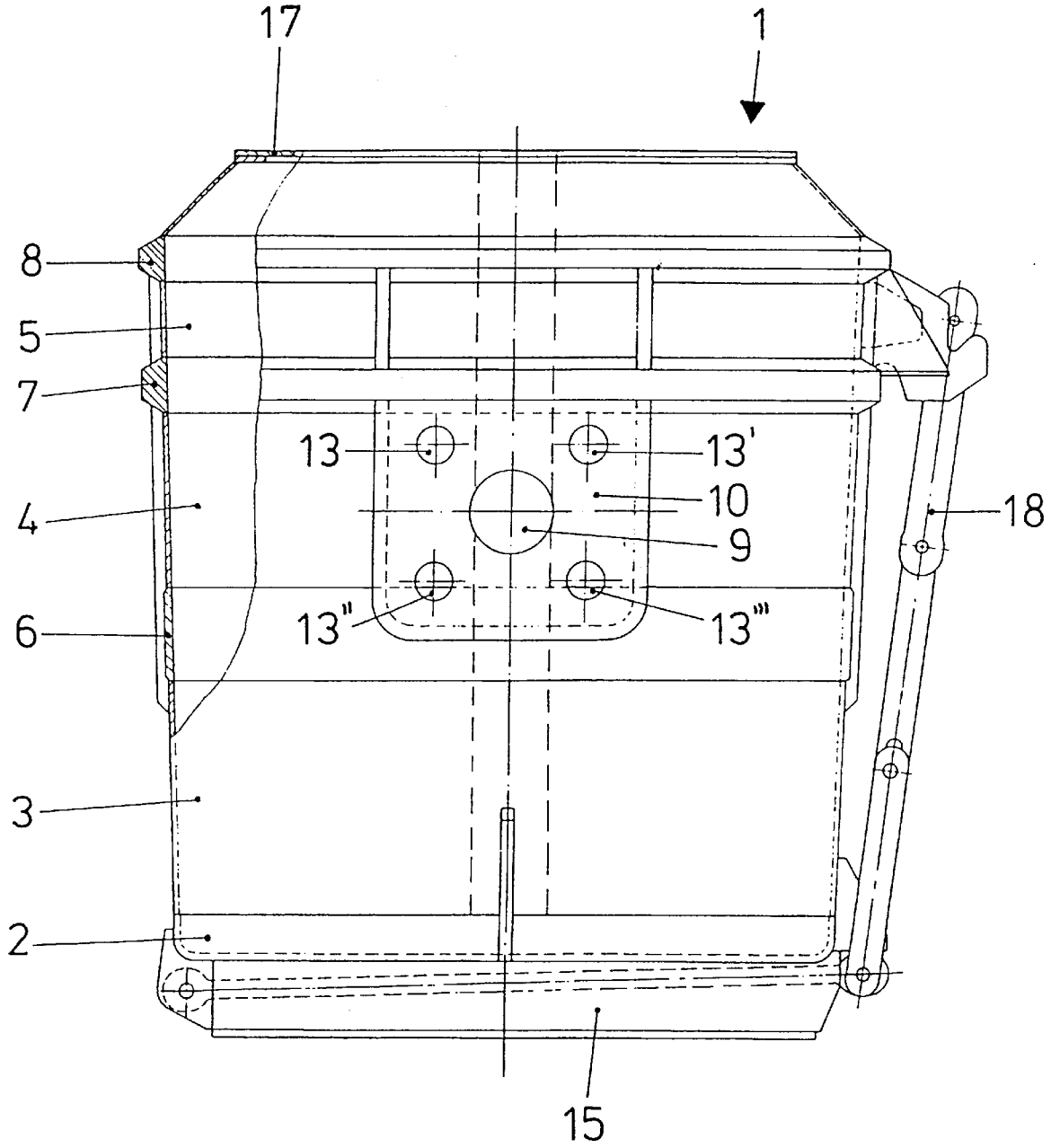
FIG. 2 shows a partially broken out side view of the vessel of FIG. 1.

FIG. 2 shows a view, rotated by 90°, of the ladle 1, of the present invention, as shown in FIG. 1. The relief recesses 13–13''' arranged in the respective plate 10, 10' can be seen clearly in this view, the recesses 13–13''' being arranged symmetrically around the carrying trunnion 9, 9'. A tilting rod linkage 18 is arranged at the outer side located on the right-hand side in the figure, so that the ladle 1 can be tipped by means of a crane. The different axial and radial dimensioning of the respective strengthening rings 6–8 can also be seen clearly in this view. The method of securing the rings 6–8 to the casing is dependent upon the height and circumference of the ladle 1.

We claim:

1. A metallurgical vessel for transporting molten metals, comprising:

a metal casing formed of a plurality of individual tubular shells, and having a bottom, an edge and an outer side;

a heat-resisting lining attached to the casing;

two circumferentially extending stiffening rings provided as an integrated component part of the metal casing in dependence upon axial dimensioning of the vessel;

a plate having upper and lower edge areas and a middle area, the plate being connected to each stiffening ring, the upper and lower edge areas of the plate being configured as rims and welded to the stiffening rings located adjacent thereto and the middle area of the plate being spaced apart by a distance from the metal casing; and two vessel carrying trunnions arranged opposite one another at the outer side of the metal casing, the trunnions being supported by the plate and configured so as to extend only outwardly from the plate.

2. The vessel in accordance with claim 1, wherein stiffening rings include a first stiffening ring closest to the bottom having a thickness that is greater, by up to a factor of 4, than a thickness of the adjoining metal casing, and a second stiffening ring located further from the bottom and having a thickness that is greater, by up to a factor of 6, than that of the adjoining metal casing, the first stiffening ring having an axial dimensioning that is at least equal to axial dimensioning of the second stiffening ring.

3. The vessel in accordance with claim 2, wherein the second stiffening ring is configured to project out from the metal casing, the lower rim edge area of the plate being welded to the first stiffening ring and the upper rim edge area of the plate being welded to a bottom side of the second stiffening ring so that the plate terminates flush with an outer surface of the second stiffening ring.

4. The vessel in accordance with claim 1, wherein the plate has relief recesses arranged symmetrically around the trunnions.

5. The vessel in accordance with claim 2, wherein a third stiffening ring is welded to the edge of the metal casing.

6. The vessel in accordance with claim 5, and further comprising a cover fastened to the third stiffening ring.

7. The vessel in accordance with claim 6, wherein the cover has a truncated-cone-shaped cross section.

* * * * *